United States Patent [19]

Warwick

[11] 4,078,529

[45] Mar. 14, 1978

[54] ROTARY ENGINE

[76] Inventor: Douglas Warwick, 44 Sonmore Dr., Toronto, Canada

[21] Appl. No.: 677,275

[22] Filed: Apr. 15, 1976

[51] Int. Cl.[2] ..... F02B 57/06

[52] U.S. Cl. ..... 123/44 C; 123/44 D; 60/39.34; 60/624; 418/88; 418/91; 418/94

[58] Field of Search ..... 123/44 C, 44 R, 44 D; 60/39.34, 597, 624; 418/88, 91, 94

[56] References Cited

U.S. PATENT DOCUMENTS

| | | | |
|---|---|---|---|
| 788,390 | 4/1905 | Bardenwerper | 123/44 D |
| 1,184,651 | 5/1916 | Johnston | 123/44 D |
| 1,272,791 | 7/1918 | Freer | 123/44 D |
| 1,292,295 | 1/1919 | Freer | 123/44 D |
| 2,253,505 | 8/1941 | Cantoni | 123/44 D |
| 2,273,025 | 2/1942 | Dillstrom | 123/44 D |
| 2,399,486 | 4/1946 | Harries | 123/44 D |
| 3,003,308 | 10/1961 | Beaven | 123/44 R |

FOREIGN PATENT DOCUMENTS

| | | | |
|---|---|---|---|
| 1,338,281 | 11/1973 | United Kingdom | 123/44 D |

*Primary Examiner*—Clarence R. Gordon

[57] ABSTRACT

A radial engine with a rotating cylinder block is disclosed which is capable of high rates of rotation although operating on the two stroke cycle. An intake air compressor and an exhaust driven turbine are provided, both in driving connection with the same output shaft as the cylinder block. A peripheral manifold serves both to provide the stator of the exhaust turbine and to mask exhaust passages from the cylinders in the block so as to modify the two stroke cycle of the engine by effectively advancing the end of the scavenge phase. A system for recovering oil from the block is disclosed, and the block is reinforced by a peripheral tension band.

12 Claims, 6 Drawing Figures

FIG.4
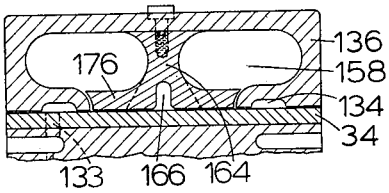
FIG.5
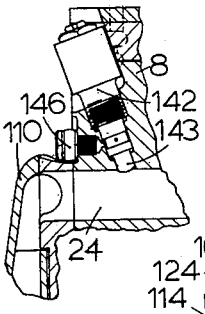
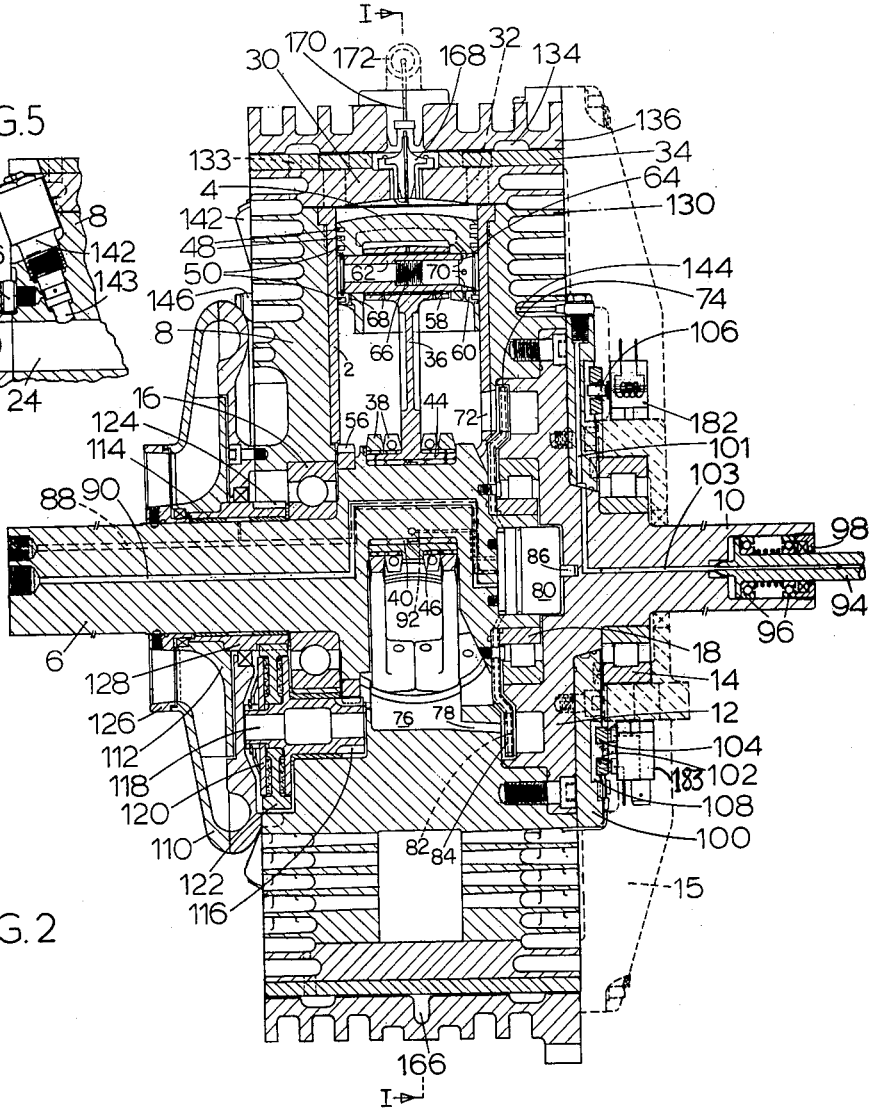
FIG. 2

ROTARY ENGINE

FIELD OF THE INVENTION

This invention relates to radial internal combustion engines of the type in which a cylinder block rotates relative to a crankshaft, the latter generally being stationary, and more particularly though not in all aspects to engines of this type employing a two stroke cycle.

REVIEW OF THE PRIOR ART

Numerous proposals have been made over many years for radial engines having cylinder blocks rotating about a stationary crankshaft, the attraction of this arrangement being that although the pistons of the engine execute a reciprocatory motion relative to their cylinders, their absolute motion is a rotation about the crankpin. Although there is a cyclical variation in rotational velocity of each piston about the crankpin, any resulting torsional moments will largely or wholly cancel in a multicylinder engine, with the result that the engine is almost perfectly balanced, whilst the block also acts as a flywheel.

Although some engines of this general type have been successfully utilized in the past, such engines have on the whole found little favour because of substantial problems in construction and operation. The rotating cylinder block is subjected to centrifugal stresses which reach very high levels at high rotational velocities, and there are problems in supplying fuel and coolant to the block. In particular, centrifugal forces also give rise to considerable lubrication problems due to the difficulty of recovering lubricant from the rapidly rotating block. For this reason, "total-loss" lubricating systems have generally been used, thus increasing lubricant consumption and exhaust pollution.

A number of the proposals which have been made for engines with rotating cylinder blocks have been for engines operating on the two stroke cycle. The advantages and disadvantages of the two stroke cycle as compared with the four stroke cycle have been discussed at length in the literature of the art and need not be recited here. Reference may be made however to "The High Speed Internal Combustion Engine", Ricardo and Hempson, 5th Edition, 1968, Chapter 10 for a discussion of these advantages and disadvantages. Suffice it to say that it has generally been considered that the two stroke cycle can normally only show advantages over the four stroke cycle in engines operating at no more than relatively moderate speeds.

Proposals have also been made to provide engines having rotating cylinder blocks with structures surrounding the block which act as valve means to control the inlet or exhaust of gases from the engine cylinders, to support turbine blades against which exhaust gases escaping from the cylinders can react, to deliver high tension electrical pulses to spark plugs in the block, and to perform various other functions. Where such structures act as manifolds for inlet or exhaust gases, it is important to prevent the escape of such gases, so some kind of seal is necessary between the manifold and the block. The provision of such seals by conventional means presents grave problems, because of the severe conditions and the large diameters and high relative velocities of the parts to be sealed.

SUMMARY OF THE INVENTION

The present invention is directed to overcoming the problems outlined above with the object of providing an internal combustion engine of high performance and high efficiency capable of running at high speeds. A rotating cylinder block is used in conjunction with a peripheral manifold in a manner which enables a two stroke cycle to be used in a high speed engine.

In my engine, the cylinder block is rendered suitable for high speeds of rotation, by forming it from a light metal alloy, and enclosing it within a prestressed high tensile steel rim which supports it against peripheral forces even though the structure of the block may need to be weakened by the presence of passages for cooling and other air flow as described in more detail below.

A peripheral stationary manifold is provided surrounding the rotating cylinder block, the outer surface rim of the cylinder block and the inner surface of the manifold cooperating to define two peripheral axially spaced annular air cushion chambers, within which air cushions are set up which not only serve to seal the edges of the gap which necessarily exists between the block and the manifold but which also help to support the stationary manifold in correct orientation relative to the rotating cylinder block.

As is conventional in two stroke engines, the pistons, which reciprocate radially relative to the cylinder block, are used to mask and unmask inlet and exhaust ports in the cylinder walls, so that during a portion the stroke of each piston extending to either side of its top dead centre position both ports are masked and during a portion of the stroke extending to either side of its bottom dead centre position neither port is masked. However, the manifold is so configured and oriented relative to the stationary crankshaft that during the latter portion of the time that each exhaust port is unmasked, the outer end of a passage leading from the port to the periphery of the rotating block adjacent the manifold is masked by the manifold structure. This modifies the operating cycle of the engine in a manner described in more detail below, rendering it suitable for high speed operation.

Moreover, the manifold defines two separate openings, through which the outer end of the passage is placed in communication with the atmosphere, normally through separate exhaust pipes and a conventional muffler arrangement. The first of these openings to enter coincidence with the exhaust passage as the cylinder block rotates preferably contains turbine blades by means of which a reaction is applied to the block assisting its rotation, supplementing the effect of further coacting blades provided in the exhaust passage. The dimensions of this first opening are such that it receives the exhaust gases released by unmasking of each exhaust port by its associated piston, which should occur prior to the unmasking of the associated inlet port. The second opening coincides with the exhaust passage whilst both ports are unmasked, and contains no turbine blades, thus minimizing resistance to scavenging of the cylinder by air entering the inlet port. Thereafter, the manifold masks the exhaust passage, preventing further loss of air and producing an effect similar to advancing substantially the masking of the exhaust port by the piston. This modifies the operating cycle of the engine in a manner which enhances efficiency and greatly facilitates high speed operation.

The necessity for total loss types of lubrication is avoided by the incorporation of an effective lubricant return system. Lubricating oil is fed through passages in the crankshaft to the crankpin journal surfaces, and oil which escapes from the crankpin bearing is thrown outwardly into the interior of the cylinder block, where surplus oil not required for lubrication of the cylinder walls is captured by the hollow interiors of the pistons, supplemented if necessary by oil capture recesses between the pistons. The oil accumulating within the pistons can escape through apertures in the piston walls, conveniently through hollow wrist pins connecting the pistons to their connecting rods, these apertures coinciding with passages in the cylinders' walls at the bottom dead centre positions of the pistons. The passages in the cylinders' walls and further passages from the oil capture recesses allow the surplus oil to run into an annular chamber from which it is withdrawn by ducts extending to the crankshaft and thence to a scavenge pump.

Air is preferably supplied to the engine by means of a compressor driven by the engine, preferably a radial flow centrifugal compressor mounted concentrically with the crankshaft. This enables gases to follow a generally radial path through the engine, the operation of which is effectively compound, with two stages of compression and two stages of expansion all drawing power from or feeding power to a common drive shaft. Thus there is first stage compression in the compressor second stage compression by the upstroke of the pistons, first stage expansion from the downstroke of the piston, and second stage expansion in the exhaust passages leading to the turbine formed by cooperation of the rotating block and the exhaust manifold.

SHORT DESCRIPTION OF THE DRAWINGS

The invention is described further with reference to the accompanying drawings showing a preferred embodiment of the invention and illustrating its operation, in which:

FIG. 1 is a radial cross section through the engine on the line I—I in FIG. 2, FIG. 2 is an axial cross section through the engine on the line II—II in FIG. 1, FIG. 3 is an end view of the engine as seen from the left hand side of FIG. 2, FIG. 4 is a fragmentary section on the line IV—IV in FIG. 1, FIG. 5 is a fragmentary section on the line V—V in FIG. 3, and FIG. 6 illustrates diagramatically the compound nature of the engine, and also illustrates how more than one bank of cylinders may be utilized in parallel.

DESCRIPTION OF THE PREFERRED EMBODIMENT

Figure 1:
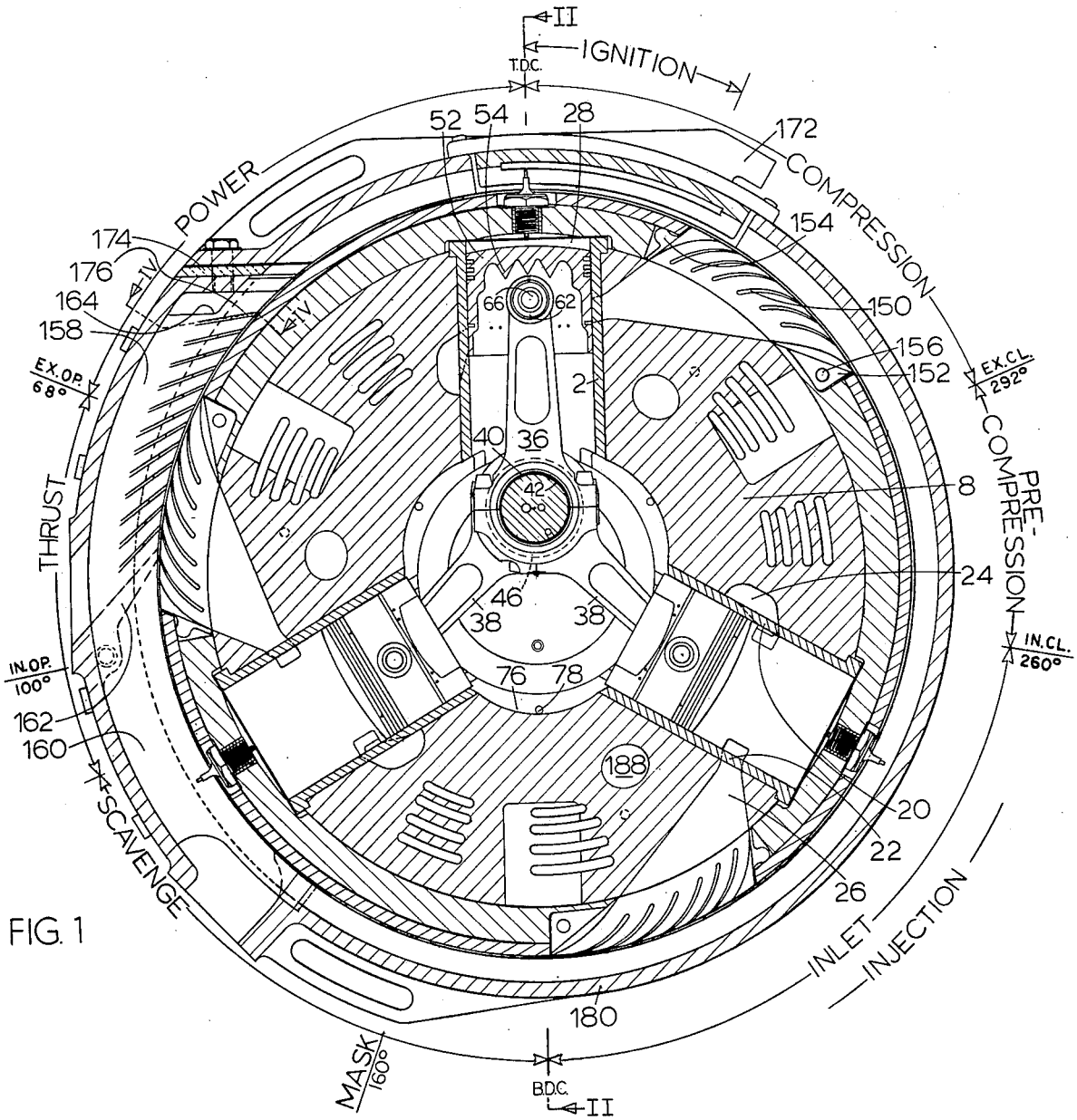

The embodiment of the engine of the invention shown in the drawings is described below. It will be understood that for the sake of clarity, engine accessories of a conventional nature such as fuel pumps, and electrical equipment have been omitted.

The rotary engine shown in FIGS. 1 to 5 consists of a single bank engine, wherein a number of cylinders having liners 2 and pistons 4 are housed in a light alloy cylinder block 8 which forms part of a rotating assembly which also does duty as a flywheel. The block rotates around a stationary forged steel crankshaft 6. An output shaft 10 is attached to the block by means of a flange 12. The output shaft runs in a prelubricated roller bearing assembly 14 which is received in a rear mounting 15 for the engine. It may also serve as an input bearing for a gearbox or transmission (not shown). A forward engine mount is formed by the stationary crankshaft 6 itself, held in a suitable known form of anti-vibration and self-aligning mounting.

The cylinder block is supported on the crankshaft by a front main bearing 16 and a rear main roller bearing 18. The rear main bearing is located between shoulders on the inner end of the output shaft 10 and the inner end of the crankshaft 6 thus allowing for expansion and also for assembly.

The cylinder block 8 is of cast aluminum or magnesium alloy. The cylinder liners 2 are of cast iron and have inlet ports 20 and exhaust ports 22 which communicate with inlet passages 24 and exhaust passages 26 extending through the cylinder block. In order to permit a sufficiently large exhaust port area whilst providing adequate support for the rings of the pistons 4, the exhaust ports and passages in fact comprise dual, parallel ports and passages.

Cylinder head combustion chambers 28 are formed in a cast alloy head band 30 which is an interference fit on the outside of the block 8. Local pressure to maintain the cylinder head joints in a gas tight condition is provided by a number of bolts 32. A high tensile steel pressure band 34 is then shrink fitted on the outside of the head band 30 providing an initial compressive stress on the cylinder block assembly, allowing engine operation at higher speeds than would otherwise be possible without danger of disintegration of the block due to centrifugal stresses.

Connecting rods of forged steel alloy connect the pistons 4 and the crankshaft 6. One cylinder (that shown uppermost in FIGS. 1 and 2) has a master rod 36, the other cylinders each having two matched connecting rods 38 with their big ends flanking the master rod on either side as seen in FIG. 2. The master rod has a weight equal to the weight of either of the other two matched pairs of rods, the complete assembly being balanced.

The master rod 36 contains a shell type bearing 40, and runs on a journal 42 of the crankpin of the crankshaft. The other rods 38 are fitted on the outside of a master rod bearing housing 44, and also have shell type bearings 46. The relative movement between the master and the other connecting rods is only a few degrees.

The pistons 4 are of aluminum alloy and fitted with a number of piston rings comprising compression rings 48 of the chrome plated type and oil scraper rings 50 of the unplated type. Each ring is positioned by a pin to ensure that the ends of the rings do not foul the ports. The piston crown 52 has a number of cooling fins or ribs 54 on its inner surface, and the piston skirt has one side machined to provide clearance for a gear ring 56 mounted on the crankshaft and referred to further below.

The little ends 58 of the connecting rods are connected to bosses 60 within the piston heads by wrist pins 62 in conventional fashion, the wrist pins being retained by circlips 64 and provided with an internally threaded bore 66 for extraction purposes. As well as conventional bores 68 in the little ends and bosses to allow lubricant escaping from the big end and crankshaft bearings into the pistons to reach the wrist pins, bores 70 are formed in the wrist pins so that lubricant accumulating in the reservoir formed within the piston crown may enter the bore 66 in the wrist pin. From the wrist pins, the oil can pass through passages 72 in the cylinder liners 2 into an annular channel 74 formed between the cylinder block and the output shaft flange 12. Lubricant captured by recesses 76 between the cylinders also passes into the channel 74 through passages 78.

Lubricant is withdrawn from the channel 74 by a scavenge section of a lubricant pump 80 through spiral ducts 82 formed in an oil return disc 84 secured to the crankshaft. The ducts are shaped so as to utilize the angular momentum of the oil in the channel 74 to assist in its return to the pump 80. The pump 80 is housed in a recess in the end of the crankshaft and has a driving connection 86 with the output shaft 10.

Lubricant from the scavenge section of the pump leaves the engine through a passage 88 in the crankshaft to an oil cooler, filter and reservoir (not shown), whence the lubricant requirements of the engine are drawn by a feed section of the pump 80 through a passage 90 and delivered to the crankpin bearings through a passage 92. The oil circulation via the pistons helps to cool the latter, which is an important advantage of the arrangement. The desirability of effective piston cooling in internal combustion piston engines has long been known but difficult heretofore to achieve.

Fuel enters the engine through a feed shaft 94 and a rotating union in the outer end of the output shaft 10. The shaft 94 is supported by pre-lubricated bearings 96 and is equipped with a seal secured with a threaded ring 98.

A balance plate 100 is located over the output shaft 10 and also forms part of the fuel system, a number of passages 101 acting as a fuel manifold admitting fuel from the shaft 94 via passages 103 in the output shaft. The balance plate further contains a commutator 102, a slip ring 104 and a number of magnets 106 which are all fitted in an annular ceramic insulator 108. The plate is also used to accept drill holes (not shown) for final balancing of the rotating mass of the engine.

A centrifugal air compressor casing 110 is attached to the front face of the cylinder block and rotates with it thus avoiding the necessity for a rotary union between the compressor and the cylinder block. However, except adjacent the hub the compressor casing is spaced from the cylinder block to avoid unnecessary heat transfer from the latter. An impeller 112 rotates around the crankshaft 6 on plain bronze alloy bearings 114 and is driven by a gear 116, a shaft 118, a friction or overrun clutch 120 to relieve or reduce shock loadings applied to the impeller on changes of engine speed, a gear 122, and a gear 124 from the gear ring 56 mounted on the crankshaft 6 adjacent the crank throw. Due to the parts 116 to 122 being mounted in an eccentric position in the rotating assembly, balance weights (not shown) are installed to restore balance.

The impeller 112 rotates in a direction opposite to the cylinder block and compressor casing 110. Apart from providing a convenient gear arrangement this serves the purpose of reducing the total angular momentum of the engine.

The impeller 112 is positioned within the casing 110 by means of shims and secured by an inlet blade ring 126 which also serves as a connection point for an air intake duct, incorporating a throttle valve, and an air filter system (not shown). The impeller 112 is cast from aluminum alloy and is a single shrouded radial blade type with inducer. It is mounted on a steel hub 128, which is integral with the gear 124. The cylinder block 8 and head band 30 are heavily finned on their front and rear faces. The fins 130 are reinforced with a number of radial fin supports 132 which are arranged to induce an axial flow of cooling air through the cylinder block and head band. Some of this air is impelled by the fin supports 132 to flow radially outwards through passages 133 in the head band 30 and pressure band 34 into two spaced circumferential grooves 134 in a manifold 136, for a purpose described further below.

A number of ducts which form the inlet passages 24 are provided in the flywheel, and connect the outer periphery of the compressor housing 110, as best seen in FIG. 5, to the cylinders. The ducts are shaped to enter the cylinders from below the inlet ports 20, as shown in FIG. 1, to provide an upward or outward flow into the cylinders, whereby to obtain a desirable flow and swirl in the latter.

Fuel injectors 142 are secured in the cylinder block 8 so that the injector nozzles 143 enter the inlet ducts 24 just upstream of the inlet ports 20. Fuel is supplied to the injectors from the manifold passages 101 by a number of pipes 144 and banjo fittings 146 to the base of the injectors 142.

A number of ducts forming the exhaust passages 26 are also provided in the cylinder block and head and the band 34 connecting the exhaust ports 22 to the periphery of the rotating assembly. The ducts have a rectangular cross section. The portions nearest the exhaust ports form the throats of divergent nozzles and the remainder the diverging portions of the nozzles so that the opening at the rim is an elongated peripherally extending slot. A number of steel turbine blades 150 are fitted into the slot as a unit. The impulse type blades are machined or cast as a single unit 152 retained in the slot by a nose 154 and a pin 156 in an arrangement allowing for expansion and assembly.

The stationary exhaust manifold 136 is a cast aluminum alloy ring machined to fit over the machined outer periphery of the band 34 with the minimum practicable working clearance.

The manifold contains two separate gas passages, naming an exhaust section 158 and a scavenge section 160, separated by a divider 162. A steel turbine blade unit 164 is fitted in the exhaust section. The blade unit 164 and the manifold are both recessed on their inner surfaces to form an annular passage 166 for the electrode of a spark plug 168. A distributor contact 170 extends to a connector in an insulative cover 172 fitted to the outside of the manifold, whence connection may be made to the remainder of an ignition system (not shown).

An exhaust pipe (not shown) and a scavenge outlet pipe (not shown) will normally be connected to the outlets of sections 158 and 160. The manifold is split at 174 to allow for the insertion of a thermal barrier strip and shims to adjust the clearance between the rotating assembly and the manifold.

The annular cavities 134 machined on the inner face of the manifold are connected to the passage 166 and are for the purpose of providing air seals of mildly pressurized and rapidly moving air, received through the passages 133, in the form of rings on each side of the exhaust and scavenge sections to contain the gases; these seals also act to a degree as an air bearing between the manifold and the band 34. There are no openings in the manifold past the end of the scavenge section and for at least the next 180 degrees of the periphery of the manifold, this portion forming a mask 180 which prevents any substantial loss of induction air from the exhaust passages 26 during filling of the cylinders.

OPERATION OF THE PREFERRED EMBODIMENT

The operation of the engine, considering one cylinder during a cycle commencing at top dead centre (T.D.C.) is as follows, assuming that a previous charge of mixture has just been ignited.

The cylinder being considered and its associated piston are in the positions shown in the top half of FIGS. 1 and 2. The ignited gases in the combustion chamber 28 expand and do work against the piston, rotating the flywheel assembly including the cylinder block in a counterclockwise direction as seen in FIG. 1 to a cylinder position of 68 degrees. At this point the exhaust port 22 is unmasked by the piston 4 and gases at high pressure and temperature escape through the exhaust port. They are then expanded through the nozzle formed by the exhaust duct 26 and attain a high velocity. In passing through the turbine rotor blades 150 and stator blades 176 of the blade unit 164 they undergo a change in direction and a change in velocity. This results in a substantial reaction force being developed on the rotating assembly in its direction of rotation. As the ejection of gases is tangential to the rim of the rotating assembly, further energy is transferred in the form of thrust and reaction.

The volumes of the exhaust and scavenge sections 158 and 160 are comparatively large. Upon entering the manifold the gases in their expanded state are deflected by the manifold blades towards the exhaust outlet. The slightly pressurized high velocity air present at the air gap due to the channels 134 offers a high impedance path to the expanded exhaust gases which are at comparatively low pressure, and therefore the exhaust gases are contained.

At 100° after T.D.C. the inlet port opens and pressurized air from the compressor housing 110 is admitted to the cylinder through the passage 24 and port 20 as the latter is unmasked by the piston 4. The flow is directed in a manner to displace the residual exhaust gases and drive them out of the exhaust port 22. This process of scavenging is assisted by the centrifugal forces present. The exhaust duct 26 is now opposite the scavenge section 160 of the manifold 136. The scavenge flow is maintained at a high velocity as the incoming air expels the residual exhaust gases from the cylinder. The reason for the separate scavenge section is to prevent the scavenge gases "seeing" any higher pressure gases left over from the exhaust cycle as would be the case in a common manifold as used in many conventional engines. Therefore two separate exhaust pipes are used, which may be joined together at a distance from the engine.

The scavenge process continues to 160° past T.D.C. where the exhaust mask acting as a secondary valve substantially blocks the exit from the exhaust duct 26. From this point the pressure in the cylinder increases as more air enters than leaks out at the air gap between the manifold 136 and the rotating assembly. This leakage can be reduced by forming additional air cushion channels in the manifold in this region.

At bottom dead centre (180° after T.D.C.) the piston begins its compressive stroke. Fuel is injected into the inlet duct 24 from the injector 142 so as to enter the cylinder just previous to the inlet port closing at 260° after T.D.C.

The piston speed has now increased and some precompression of the mixture in the cylinder takes place to a position of 292° after T.D.C. where the exhaust port 22 closes as it is masked by the rising piston. This is followed by compression and ignition of the gases, thus completing the cycle. The remaining two cylinders operate on a similar cycle, following each other at 120° intervals. Whilst the use of three cylinders in a bank, as shown, is believed to be the most practicable arrangement, there is of course no reason why different numbers of pistons and cylinders could not be employed. Likewise, it should be understood that the timing of the opening and closing of the inlet and exhaust ports indicated in the foregoing description is by way of example only, and variations in timing in different applications or with different engine dimensions may be made as necessary as in conventional internal combustion engines. However, it will be understood that it is inherent in the porting arrangement used that the unmasking and masking of the inlet and exhaust ports will occur at points symmetrical about top dead centre. The use of the mask 180 incorporated in the exhaust manifold enables this design constriction to be overcome by effectively advancing the point at which the exhaust port is closed, thus providing almost the same flexibility in selecting the portions of the cycle during which the inlet and exhaust ports are open as is available in a four stroke engine.

Ignition and fuel injection are preferably under electronic control, use being made of any of many known systems. Ignition timing is controlled by the magnets 106 located in the balance plate 100, these causing a pulse to be generated in a stationary sensor coil 182 as they pass the latter. This pulse is amplified and used, suitably delayed, to trigger an electronic or capacitor discharge ignition system. The same pulse is used to control actuation of the injectors which incorporate electrically operated valves, the necessary control signals being transmitted to the rotating flywheel assembly by the commutator 102, whilst the assembly is grounded through the slip ring 104, via carbon brushes in a brush holder 183. The electronic system adjusts the ignition timing and also the injection duration by means of a computation derived in known manner from various engine operating parameters such as engine speed, throttle position, inlet air flow rate, etc. Fuel is supplied to the engine by an electric fuel pump (not shown) equipped with a pressure relief valve.

An important consideration in the manufacture and maintenance of an engine is that it should be easy to assemble and disassemble. Some past paper proposals for radial engines have suffered from the defect that whatever their theoretical merits, they are impossible to manufacture because their assembly is a topological impossibility. The present engine is readily assembled and disassembled.

In order to assemble the major components of the engine, the crankshaft 6 complete with the front main bearing 16, in the gear ring 56, the rear main inner bearing 18, and the oil return disc 84, is inserted in the cylinder block from the rear. The connecting rods are then fitted through the cylinder bores, and their big ends are secured around the crankpin, access being available for this purpose through the bores. The rods are then positioned to receive the pistons, each complete with its forward circlip 64. Each piston is aligned with its respective connecting rod or rods at the bottom dead centre position, whereupon the wrist pin is inserted through the oil opening 72 in the cylinder wall and an aligned opening in the disc 84, and the rearward circlip 64 is fitted. The output shaft is then fitted and secured, the oil pump having previously been mounted in its recess in the end of the crankshaft, the head band 30 and reinforcing band 34 are fitted to the cylinder block, and the manifold 136 is mounted so as to surround the band 34 by means of mounting brackets secured to the rear mounting 15 which also supports the output shaft 10 and the bearing 14.

Figure 6:
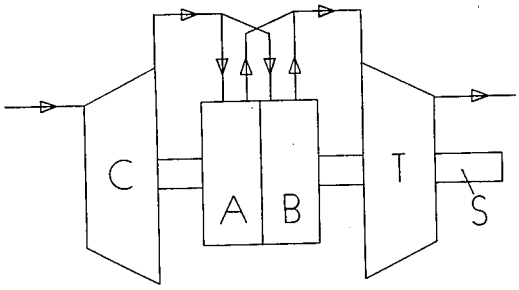
Figure 3:
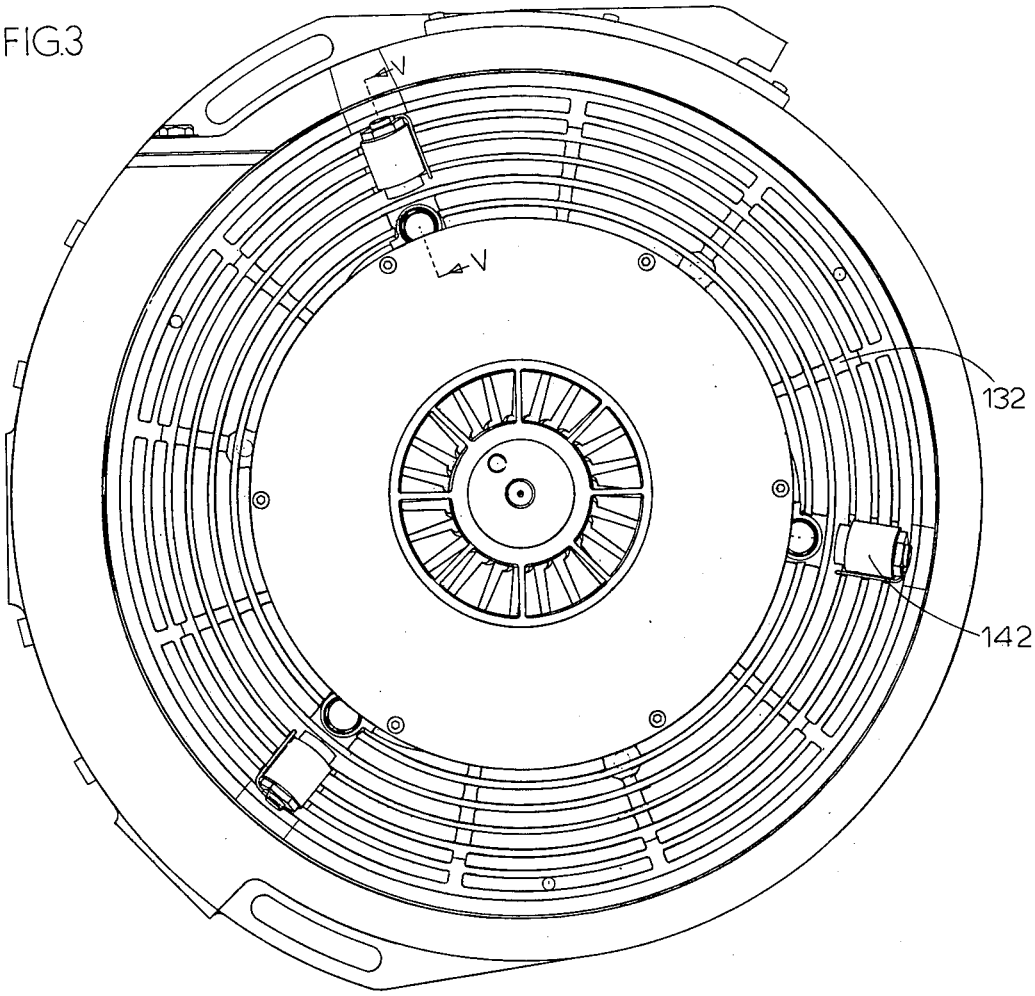

The engine which has been described above is a compound engine, both in the sense that the compression of the inlet gases prior to their ignition takes place in two stages, and in the sense that energy is recovered from the expanding gases after ignition in two stages. This is illustrated in FIG. 6, where inlet air is shown entering a compressor C, represented by the housing 110 and the impeller 112, whence it passes to a cylinder bank A or B (the engine shown in this Figure is a two bank engine rather than the single bank engine described above), where the gases are further compressed, energy for both stages of compression being drawn from a shaft S. However, before leaving the cylinder banks, the gases are ignited and expand, giving up energy to the shaft S, before being expanded while passing to a turbine T, formed by the blades 150 and 176, where they give up more energy to the shaft.

In conventional turbo-charging, some energy from the exhaust gases of an internal combustion engine is given up to a turbine, used to drive a compressor feeding air to the engine. Two stroke engines with higher pumping losses at higher speeds have benefitted in particular by the use of turbo-chargers in reducing these pumping losses. Connection of the components (exhaust turbine and air compressor) of a turbo-charger to the crankshaft of its associated engine by gears or otherwise results in a compound engine, with the energy recovered from the exhaust gases over and above that required to drive the compressor being available at the output shaft. These principles applied to a rotary engine such as has been described result in a very compact multicylinder compound engine of high efficiency.

The energy from the exhaust turbine section is supplied to the compressor by the rotating assembly, so as to permit the excess becoming available at the output shaft of the engine. Compared to a conventional turbocharger arrangement, the advantages of the mechanically driven centrifugal compressor are retained. At the same time the assistance of the turbine is retained.

By nature of its principle the centrifugal compressor rotor requires a high speed of rotation, several times greater than that of the cylinder block. This is attained by the geared drive from the crankshaft that has been described. In the example shown the ratio of this drive is 5.25 to 1, giving a relative speed between impeller and housing of about 32,000 r.p.m. for an engine speed of 6,000 r.p.m. This ratio can of course be varied to suit individual engine or compressor designs. Although the exhaust turbine in the present case is operated at a lower speed than optimum, resulting theoretically in reduced efficiency, some compensation is realized by utilization of the exhaust energy immediately after the gases leave the cylinder exhaust port, resulting in elimination of the losses usually incurred in long exhaust tracts and bends, as in conventional engines. The turbine is also enabled to operate under pulse conditions resulting in higher power.

A somewhat higher starting speed will be required than for conventional engines unless an auxiliary pressurized air supply is available to supply induction air to the engine during starting. No starting device is shown in the drawings, but starting torque could be applied through the output shaft in any of a variety of known ways.

It will be apparent to those skilled in the art that the improvements of the present invention are directed at both compression ignition engines and spark ignition engines, although the drawings show a spark ignition engine. Similarly, there are features of the engine such as the lubrication system and the construction of the rotating assembly which could be applied to radial engines operating on different types of two stroke or four stroke cycle. It will also be apparent that a wide range of detail variations may be made in the structure of the engine described without departing from the scope of the invention as defined in the appended claims.

Throughout the design, provision has been made for the use of multiple cylinder banks (see banks A and B in FIG. 6). Intake ducts 188 (see FIG. 1) for a second bank of cylinders behind the first may be formed and used for lightening holes, in addition to lightening holes 131, in the single bank engine illustrated in the drawing, basically the same casting being used in a multiple bank engine. A longer crankshaft with an additional throw would of course be required, as well as other detail changes which will readily be apparent to those skilled in the art.

It would also be possible to operate the engine described without the exhaust manifold assembly, although by doing so many of its advantages would be lost, and alternative structure would be required to distribute ignition impulses to the spark plugs and to receive the exhaust gases.

What I claim is:

1. A two stroke rotary internal combustion engine comprising a cylinder block assembly defining the walls of radially extending cylinders and cylinder heads closing the radially outward ends of said cylinders, a stationary crankshaft, pistons reciprocating relative to said cylinders, said block assembly being rotatable in a predetermined direction relative to said crankshaft, connecting rods connecting the pistons to the crankshaft, a stationary exhaust manifold member adjacent the external periphery of the cylinder block assembly, and an output shaft connected to the cylinder block assembly, wherein the cylinder block defines inlet and exhaust passages, the inlet passages extending through the cylinder block from air compression means to inlet ports in the cylinders, and the exhaust passages extending outwardly through the cylinder block in a trailing direction relative to said predetermined direction from exhaust ports in the cylinder walls to outer openings in the external periphery of the cylinder block assembly, the inlet and exhaust ports both being positioned to be masked and unmasked by reciprocatory movement of the pistons in the cylinders so that both ports associated with a particular cylinder are open during the radially innermost portion of the stroke of the associated piston and both ports are closed by the piston during the radially outermost portion of the stroke of the piston, the manifold being formed with at least one exhaust chamber so configured and so oriented relative to the crankshaft that it is aligned with the outer opening of the exhaust passage associated with each successive cylinder during relative rotation of the cylinder block assembly and the manifold only during a first part of the period when the exhaust port associated with the exhaust passage is unmasked by the associated piston, and the outer opening of the exhaust passage is masked by the exhaust manifold for the remainder of the period that the port is unmasked.

2. An engine according to claim 1 wherein the exhaust chamber in the manifold is formed in two portions separated so as to enter sequential alignment with the outer opening of each exhaust passage as the cylinder block rotates relative to the manifold, the manifold including blades in the first portion only of said passage, the blades being oriented so as to provide a reaction to gas flow from said passages such as to assist relative rotation of the cylinder block and the manifold.

3. An engine according to claim 2, wherein the air compression means comprises a centrifugal radial flow compressor having an impeller located within a housing attached to the cylinder block assembly, and in communication with said inlet ports, the impeller having a rotational axis common with that of the cylinder block assembly, drive means being provided placing said impeller in driving connection with both said crankshaft and said cylinder block.

4. An engine according to claim 3, wherein the drive means comprises a cycloid gear train having a ratio such as to drive the impeller at a higher speed of rotation than said cylinder block.

5. An engine according to claim 4, wherein said drive means is such as to drive the impeller in a direction opposite to the rotation of said cylinder block.

6. An engine according to claim 2, wherein the exhaust port of each cylinder is unmasked by its piston before its inlet port, and the first section of the passage in said exhaust manifold is aligned with the outlet of the associated exhaust passage during the period between the unmasking by the piston of the exhaust port and its unmasking of the inlet port.

7. A compound gas engine having a first compression stage formed by a centrifugal compressor receiving atmospheric air, a second compression stage and first expansion stage formed by a radial multi-cylinder two stroke piston engine assembly having a rotating cylinder block, a crankshaft, and pistons orbiting the rotational axis of the cylinder block and reciprocating relative to radially extending cylinders, said second compression stage receiving air from said first compression stage, and a second expansion stage receiving exhaust gases from said first expansion stages and comprising an impulse turbine, said compressor, said radial engine assembly and said turbine being adjacently mounted on a common rotational axis, all in driving connection with a common output shaft, and so that the outlet of the centrifugal compressor connects with inlet ports to the cylinders of the radial engine assembly and exhaust ports from the cylinders of the radial engine assembly communicate via passages of expanding cross-section with the inlet to the turbine, the relative movement of said pistons and said cylinders being timed, and the locations of said ports in said cylinders being selected so as to permit successive compression, ignition, expansion, exhaust and scavenging of gas admitted to the cylinders, and the relative dispositions of the compressor, the engine assembly and the turbine being such that the path of the gases through the engine extends outwardly from said compressor inlet to said inlet ports and from said exhaust ports through said expanding passages and said turbine, and said exhaust ports are radially outward of said inlet ports.

8. An engine according to claim 7, wherein the turbine comprises a manifold assembly defining in circumferential sequence a first gas passage housing a set of turbine stator blades and oriented to receive gases from successive cylinders through said exhaust ports during exhausting of said cylinders, a second gas passage oriented to receive gases from successive cylinders through said exhaust ports during scavenging of said cylinders, and a mask thereafter blocking egress of air from said exhaust ports.

9. An engine according to claim 8, wherein the second compression stage and first expansion stage comprise a plurality of radial cylinder two stroke piston engine assemblies having a common crankshaft.

10. In a rotary internal combustion engine of the type having pistons reciprocating radially in a cylinder block rotating about a crankshaft to which the pistons are connected by piston rods, a lubrication and cooling system comprising feed conduit means for oil forming a lubricant and coolant, said means extending through said crankshaft to bearing surfaces thereof in sliding contact with said connecting rods, coolant collection reservoirs within the crowns of the pistons and facing said crankshaft to receive oil escaping therefrom, passageway means in each said piston and in said cylinder block oriented so as to be in alignment when said piston is at bottom dead centre, an annular chamber in said block in communication with said passageway means therein, duct means extending radially from said crankshaft into said annular chamber, and a scavenge pump receiving oil from said duct means.

11. In a rotary internal combustion engine operating on a cycle having inlet, compression, power and exhaust phases, comprising a cylinder block assembly rotating about a crankshaft and within a stationary exhaust manifold structure, said cylinder block assembly defining radial cylinders, cylinder heads closing the outward ends of said cylinders, exhaust passages extending from ports in the cylinders to the external periphery of the cylinder block assembly, and means obturating said ports during said compression and power phases, the improvement wherein the cylinder block and the manifold cooperate at their periphery to define at least two axially spaced annular air cushion chambers, and means are provided placing said chambers in communication with a source of pressurized air, whereby to provide air cushions between the cylinder block assembly and the manifold which form axially spaced air seals enclosing the space between said chambers, said cylinder block and said manifold.

12. An engine according to claim 2, wherein the exhaust passages in the cylinder block form nozzles of which the cross section expands towards the outer end of the passage.

* * * * *